US005145113A

United States Patent [19]

Burwell et al.

[11] Patent Number: 5,145,113

[45] Date of Patent: Sep. 8, 1992

[54] ULTRASONIC GENERATION OF A SUBMICRON AEROSOL MIST

[75] Inventors: Donald E. Burwell, Wethersfield; James L. Yanosy, Granby; Glen R. Coates, Suffield; James R. O'Coin, Windsor Locks, all of Conn.

[73] Assignee: United Technologies Corporation, Hartford, Conn.

[21] Appl. No.: 752,751

[22] Filed: Aug. 30, 1991

[51] Int. Cl.[5] ..... B05B 1/08

[52] U.S. Cl. ..... 239/102.2; 310/323

[58] Field of Search ..... 239/102.2; 310/323, 310/324

[56] References Cited

U.S. PATENT DOCUMENTS 4,123,481 10/1978 Herold et al. ..... 261/81

4,659,014 4/1987 Soth et al. ..... 239/102.2

*Primary Examiner*—Andres Kashnikow

*Assistant Examiner*—Lesley Morris

[57] ABSTRACT

An ultrasonic piezoelectric aerosol submicron mist generator is disclosed having a high-frequency, piezoelectric crystal (18) which is vibratible at a selected frequency to atomize a liquid (24) that has been evenly distributed over the crystal (18) via an annular flow control washer (28). The atomized liquid (24) forms a mist (20) thereafter received into a mixing chamber (30) wherein the mist (20) is entrained into a low pressure gas (36). The low pressure gas (36) transports the entrained mist (20) about a separator plate (32), whereby the mist (20) must change flow direction in order to exit a nozzle outlet (42) thus forcing droplets (40) larger than the desired size to separate from the low pressure gas (36) before reaching the nozzle outlet (42).

8 Claims, 1 Drawing Sheet

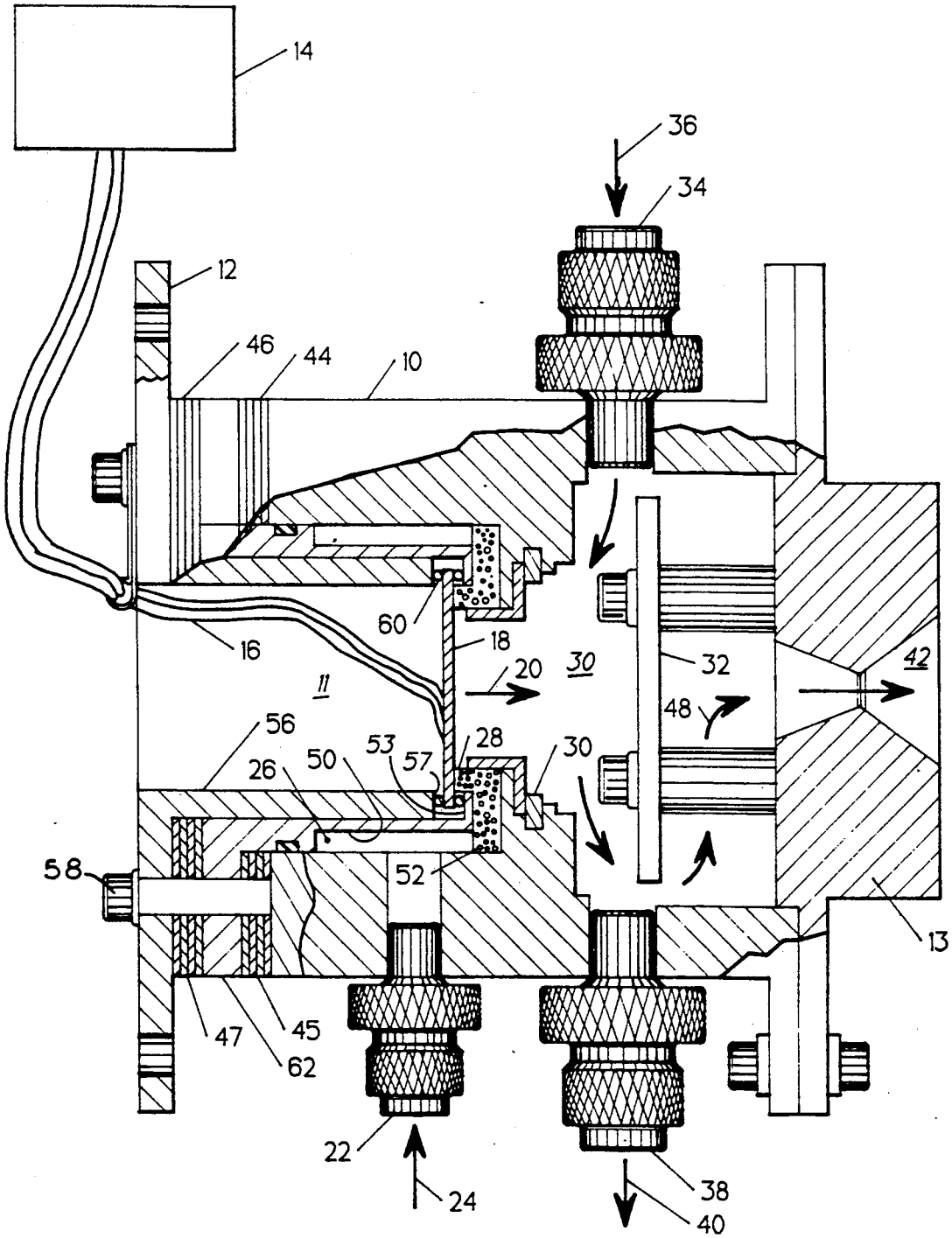
14
36
34
12
46
44
10
60
18
16
20
30
32
42
11
48
56
53
28
30
26
50
57
58
52
13
47
45
62
22
24
38
40

ULTRASONIC GENERATION OF A SUBMICRON AEROSOL MIST

TECHNICAL FIELD

This invention relates to ultrasonic generation of an aerosol mist, and more particularly to a high-frequency piezoelectric mist generator wherein a liquid is atomized into a carrier gas to produce an aerosol mist containing very fine droplets from less than 1 to 15 microns in diameter.

BACKGROUND ART

Atomization is used to produce sprays and mists employed in a variety of industrial applications such as combustion, process industries, agriculture, meteorology, and medicine. A major concern in atomization is the size of the drops produced since some applications, such as combustion, require small droplets, where in other areas, such as crop spraying small droplets must be avoided. The primary techniques currently used for atomizing a liquid are pressure, rotary, pneumatic, ultrasonic, and electrostatic. Although conventional atomizers employing such techniques function well for most industrial applications, they are incapable of reliably producing submicron droplets—an important requirement in applications where the presence of larger droplets would cause operational difficulties in subsequent utilization.

In conventional ultrasonic atomizers, the liquid is fed into an atomizing nozzle and then flows through or over a piezoelectric transducer and horn, which vibrate at ultrasonic frequencies to produce short wavelengths which atomize the liquid. Typically, such conventional ultrasonic atomizing nozzles incorporate a low-frequency electrical input from 25 to 120 kHz, two piezoelectric transducers, and a stepped horn to produce weight mean droplet diameters in the range of 25 to 100 microns. Other conventional ultrasonic atomizers have been used in medical applications to produce droplets in the range of 1 to 5 microns, however, they are not able to produce submicron droplets required in some industrial applications.

DISCLOSURE OF THE INVENTION

An object of the invention is to provide an apparatus for producing a submicron aerosol mist.

Another object is to provide an apparatus for producing a submicron aerosol mist, which apparatus is capable of being designed to function with its nozzle disposed in a variety of orientations.

According to the present invention, an ultrasonic piezoelectric aerosol submicron mist generator includes a high-frequency, piezoelectric crystal which is vibrated at a selected frequency to atomize a liquid that has been evenly distributed over the crystal via an annular flow control washer, thereby producing a mist thereafter received into a mixing chamber wherein the mist is entrained into a low pressure gas that transports it about a separator plate disposed within the mixing chamber adjacent to a nozzle outlet, whereby the mist must change flow direction in order to exit the nozzle outlet thus forcing droplets larger than the desired size to separate from the carrier gas before reaching the nozzle outlet.

The flow control washer also functions to control the flow rate of the liquid over the piezoelectric crystal and can be employed with liquids of different viscosities.

The flow control washer comprises a wick like material, such as felt, or other compressible materials. The compression on the flow control washer is altered by varying the thickness of a squeeze shim means thereby either increasing or decreasing the degree of compression on the flow control washer so as to regulate the pressure drop across the washer depending on the liquid being atomized thereby controlling the flow of liquid across the piezoelectric crystal and thus permitting liquids of different viscosities to flow through the control washer and be atomized.

Additionally, the droplet size may be regulated by varying the frequency of the piezoelectric crystal thereby permitting smaller droplets to be produced when utilizing higher frequency crystals. The frequency of the crystal increases as the thickness of the crystal decreases, thus a range of droplet sizes may be created by varying the thickness of the crystal. This may be effected by changing the thickness of a shim means to compensate for crystals of different thicknesses and thereby to ensure a tight fit irrespective of the thickness of the crystal itself.

According to a further aspect of this invention, the separator plate is disposed in the mixing chamber such that the mist entrained in the low pressure gas must negotiate a 90–180 degree turn around the separator plate which causes a sharp change in flow direction and forces droplets larger than the desired size to separate from the carrier gas, impinge on the walls of the nozzle, and thereafter flow out a drain. Droplets of the desired size successfully negotiate the turn around the separator plate and thereafter flow out of the nozzle outlet.

The nozzle of the invention provides good atomization at controllable flow rates and produces droplets in the range of less than 1 to 15 microns through a nozzle that can be used in a variety of orientations. The nozzle of the invention has low power requirements, may be implemented using any flowable liquid, and is free from flow instabilities. The mist generator is inexpensive, light weight, easy to maintain and remove for servicing, durable, easily manufactured and assembled, and can be made of any available material which can be formed into the proper configuration.

The foregoing and other objects, features and advantages of the present invention will become more apparent in the light of the following detailed description of exemplary embodiments thereof, as illustrated in the accompanying drawing.

BRIEF DESCRIPTION OF DRAWINGS

The sole FIGURE of the drawing is a partially broken away, side elevation view of an ultrasonic piezoelectric mist generator in accordance with the present invention.

BEST MODE FOR CARRYING OUT THE INVENTION

Referring now to the drawing, an ultrasonic piezoelectric submicron aerosol mist generator includes an annular nozzle body 10 supported on a base end plate 12 adapted for mounting to a support surface and capped by a face plate 13. The nozzle body 10 defines an interior cavity 11 therein and includes a nozzle outlet 42 centrally disposed within the face plate 13 and opening into the interior cavity 11. A piezoelectric crystal 18 is disposed within the interior cavity 11 spaced oppositely from the nozzle outlet 42 and is operatively connected to an electrical controller 14 via electrical leads 16 which pass through the base end plate 12 to attach to the piezoelectric crystal 18. The electrical controller 14 generates a signal, for example the signal may comprise a 1 MHz sine wave, to vibrate the piezoelectric crystal 18.

A liquid inlet 22 is provided in the side of the nozzle body 10 to receive a flowable liquid 24, typically at a pressure of 0.1–5 psig. Thereafter, the liquid 24 flows from the inlet 22 into an annular cavity 26 where it wets an annular flow control washer 28 which evenly distributes and controls the flow rate of the liquid 24 over the piezoelectric crystal 18. The annular flow control washer 28 comprises a wick like material, such as felt, or other compressible material which may be adjusted by tightening or loosening the squeeze on it.

The piezoelectric crystal 18 typically comprises Lead Titanate Zirconate, although other piezoelectric materials may be utilized which are capable of vibrating at an amplitude and frequency which will properly atomize the liquid 24 at a low flow rate. The vibration of the piezoelectric crystal 18 at a desired frequency causes the liquid 24 delivered through the annular flow control washer 28 onto the surface of the crystal 18 to atomize, thereby producing a mist 20 of the desired particle size. The mist 20 formed from the liquid 24 delivered through the control washer 28 onto the surface of the piezoelectric crystal 18 is thereafter received into a mixing chamber 30 disposed within the upper portion of the nozzle body between the piezoelectric crystal 18 and the nozzle outlet 42. The mist 20 is entrained into a low pressure gas 36 which enters the mixing chamber 30 via a gas inlet 34 located in the side wall of the nozzle body 10 and exits the mixing chamber 30 via a nozzle outlet 42 at the end face 13 of the nozzle body 10. The gas 36 carries the mist 20 about a separator plate 32 disposed within the mixing chamber 30 adjacent to a nozzle outlet 42 such that the mist 20 entrained in the gas 36 must negotiate a 90–180 degree turn around the separator plate 32 in order to flow out of the nozzle outlet 42. Negotiating the turn about the separator plate 32 causes a sharp change in flow direction. Thus, due to their larger momentum, droplets 40 larger than the desired size cannot negotiate the sharp turn but rather separate from the carrier gas 36, impinge on the walls of the nozzle body 10, and thereafter flow out a drain 38 in the side wall of the nozzle body 10. Droplets 48 of the desired size successfully negotiate the turn around the separator plate 32 and thereafter flow out of the nozzle outlet 42. The flow rate of the droplets 48 of the desired size out of the nozzle outlet 42 may be rapidly changed by varying the velocity at which the carrier gas 36 is injected into the nozzle body 10.

The control washer 28 is disposed in an annular void situated between a shoulder 54 projecting inwardly from the nozzle body 10 into the interior cavity 11, and an endface 52 of an outer annular sleeve 50 extending axially toward the base end plate 12. A first shim pack 44 is disposed between the nozzle body 10 and a flange 62 extending outwardly from the base of the annular sleeve 50 to provide for tightening or loosening the compression on the annular flow control washer 28. The number and thickness of the shim plates 45 forming the shim pack 44 can be adjusted to selectively position the endface of the outer annular sleeve 50 relative to the shoulder 54 so as to increase or decrease the squeeze on the flow control washer 28. By removing one of the shim plates 45 and adjusting a bolt 58 so as to close the gap left by removing the plate 45, the endface 52 of the outer annular sleeve 50 is positioned closer to the shoulder 54 thereby increasing the pressure on the flow control washer 28. To decrease the squeeze on the flow control washer 28 a shim plate 45 is added, the bolt 58 is loosened and the thickness of the shim pack 44 is thereby increased thus positioning the endface 52 of the outer annular sleeve 50 further from the shoulder 54 thereby decreasing the pressure on the flow control washer 28. By so adjusting the compression on the flow control washer 28 the pressure drop across the washer 28 is varied depending on the viscosity of the liquid 24 being atomized. This permits liquids with different viscosities to evenly flow through the washer 28 while also controlling their flow rate across the piezoelectric crystal 18 thus allowing different liquids to be atomized.

The endface 52 of the outer annular sleeve 50 forms an annular lip 53 extending radially inward over the piezoelectric crystal 18. The piezoelectric crystal 18 is supported by seating seals 60 between the lip 53 and an endface 57 of an inner annular sleeve 56 extending outwardly from the base end plate 12 into the cavity 11. A second shim pack 46 comprised of shim plates 47 is provided between the base end plate 12 and the flange 62 of the outer annular sleeve 50 to permit piezoelectric crystals 18 of varying thicknesses to be utilized. By removing one of the plates 47 and tightening the bolt 58, the space between the lip 53 and the endface 57 of the inner annular sleeve 56 is decreased; and likewise by adding a shim plate 47 and loosening the bolt 58, the space between the lip 53 and the endface 57 of the inner annular sleeve 56 is increased. By so adjusting the position of the endface 57 of the inner annular sleeve 56 relative to the annular lip 53, a tight fit between the seating seals 60 and the piezoelectric crystal 18 is achieved irrespective of the thickness of the piezoelectric crystal 18 itself. The frequency of a given crystal 18 increases as the thickness of the piezoelectric crystal 18 decreases; thus, a range of droplet sizes may be created by varying the thickness of the crystal 18.

The nozzle body 10 may be made of any material, such as brass, with suitable properties, for example strength and corrosion resistance, appropriate for the environment for which it is to be used and which is otherwise compatible with the liquid 24 being atomized. When atomizing corrosive liquids, it may be necessary to coat the piezoelectric crystal 18 with a corrosion resistant material such as gold.

The drain 38 should be sized relative to the nozzle outlet 42 so as to allow droplets 40 larger than the desired size to flow out of the nozzle body 10 via the drain 38 without inducing the carrier gas 36 with droplets 48 of the desired size entrained therein to flow out of the drain 38 instead of the nozzle outlet 42.

To illustrate the effectiveness of the nozzle water was injected into the nozzle body at a rate of 1 gram/min, the electrical controller generated a 360 Hz pulsed square wave to vibrate the 1 MHz piezoelectric crystal which atomized the liquid to form the mist which was thereafter entrained by the carrier gas flowing at a rate of 20 l/min. The flow rate of the entrained liquid out of the nozzle was 0.1 grams/min and over 90% by volume of the entrained droplets were less than 0.7 microns in diameter with 50% by volume of the entrained droplets ranging from 0.07 to 0.52 microns in diameter.

Although the invention has been shown and described with respect to exemplary embodiments thereof, it should be understood by those skilled in the art that various changes, omissions, and additions may be made therein and thereto, without departing from the spirit and the scope of the invention.

We claim:

1. An apparatus for generating a mist comprising:

a nozzle body having an interior cavity and a nozzle outlet opening into the interior cavity;

a piezoelectric crystal disposed within the interior cavity spaced oppositely from said nozzle outlet, said piezoelectric crystal having a surface circumscribed by a periphery for receiving a liquid to be atomized and being vibratible at a selected frequency so as to atomize the liquid received thereon into droplets;

a mixing chamber disposed between said piezoelectric crystal and said nozzle outlet and for receiving the droplets of atomized liquid from the surface of said piezoelectric crystal;

an annular flow control washer disposed adjacent to the periphery of said piezoelectric crystal for distributing the liquid to be atomized over the surface thereof, said control washer comprising a compressible wick-like material;

means for selectively compressing said control washer;

means for delivering the liquid to be atomized through the nozzle body to said control washer; and means for injecting a low pressure gas into said mixing chamber at a desired rate as a carrier gas for entraining and carrying the droplets of atomized liquid through said nozzle outlet.

2. Apparatus according to claim 1, further comprising:

a separator plate disposed within said mixing chamber adjacent to said nozzle outlet whereby the carrier gas and the droplets of the atomized liquid entrained in the carrier gas must pass about said separator plate in order to flow out said nozzle outlet thereby causing an oversize portion of the droplets of the atomized liquid to separate therefrom.

3. Apparatus according to claim 2, further comprising:

means for draining the droplets of the atomized liquid separated from the gas out of the nozzle body.

4. Apparatus according to claim 1, further comprising:

an inner annular sleeve mounted to the nozzle body and extending into the interior cavity, the inner annular sleeve having a tip end supporting said piezoelectric crystal;

an outer annular sleeve mounted to the nozzle body and extending into the interior cavity about the inner annular sleeve, the outer annular sleeve having a lip extending radially inward over said piezoelectric crystal and supported on the tip end of the inner annular sleeve; and means for selectively positioning the tip end of the inner annular sleeve relative to the lip of the outer annular sleeve thereby creating a variable gap therebetween wherein said piezoelectric crystal is disposed.

5. Apparatus according to claim 4, wherein said means for selectively positioning the tip end of the inner annular sleeve relative to the lip of the outer annular sleeve comprises a shim pack made up of a plurality of shim plates.

6. Apparatus according to claim 1, wherein said piezoelectric crystal comprises a Lead Titanate Zirconate piezoelectric crystal.

7. Apparatus according to claim 1, further comprising:

an annular shoulder projecting inwardly from the nozzle body into the interior cavity so as to extend about said flow control washer; and an outer annular sleeve mounted to the nozzle body and extending into the interior cavity, said outer annular sleeve having an endface spaced oppositely said shoulder and partially supporting said flow control washer.

8. Apparatus according to claim 7, wherein the means for selectively compressing said control washer comprises a shim pack operatively disposed between the inner and outer annular sleeve, said shim pack made up of a plurality of shim plates for selectively positioning the endface of the outer annular sleeve relative to the shoulder.

* * * * *